US007210535B2

(12) United States Patent
Turner

(10) Patent No.: US 7,210,535 B2
(45) Date of Patent: May 1, 2007

(54) ISOLATION SYSTEM COMPRISING A PLUG AND A CIRCULATION VALVE AND METHOD OF USE

(75) Inventor: Dewayne M. Turner, Tomball, TX (US)

(73) Assignee: BJ Services Company, Houston, TX (US)

( * ) Notice: Subject to any disclaimer, the term of this patent is extended or adjusted under 35 U.S.C. 154(b) by 175 days.

(21) Appl. No.: 11/034,228

(22) Filed: Jan. 12, 2005

(65) Prior Publication Data

US 2006/0151183 A1 Jul. 13, 2006

(51) Int. Cl.
*E21B 33/12* (2006.01)

(52) U.S. Cl. ..... 166/386; 166/387; 166/192

(58) Field of Classification Search ..... 166/386
See application file for complete search history.

(56) References Cited

U.S. PATENT DOCUMENTS

| | | | | |
|---|---|---|---|---|
| 3,757,816 | A * | 9/1973 | Price | 137/498 |
| 4,694,903 | A * | 9/1987 | Ringgenberg | 166/250.08 |
| 5,890,540 | A * | 4/1999 | Pia et al. | 166/321 |
| 6,662,877 | B2 * | 12/2003 | Patel | 166/386 |
| 7,055,598 | B2 * | 6/2006 | Ross et al. | 166/236 |
| 2002/0033262 | A1 * | 3/2002 | Musselwhite et al. | 166/285 |
| 2004/0084190 | A1 * | 5/2004 | Hill et al. | 166/386 |

* cited by examiner

*Primary Examiner*—Frank Tsay
(74) *Attorney, Agent, or Firm*—Locke Liddell & Sapp LLP

(57) ABSTRACT

An isolation system for an oil and gas well is described wherein the system comprises an isolation section and a first isolation device integral with the section and a second isolation device sealingly engaged to the section. The first isolation device may be a pressure-actuated valve and the second isolation device may be a plug.

12 Claims, 7 Drawing Sheets

ISOLATION SYSTEM COMPRISING A PLUG AND A CIRCULATION VALVE AND METHOD OF USE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

This disclosure relates generally to an isolation system for oil and gas wells and, more particularly, to a formation isolation system comprising a first integral and actuatable isolation device and a second isolation device.

2. Description of the Related Art

A typical hydrocarbon well may utilize one or more gravel packs and screen assemblies to enhance production from, for example, unconsolidated formations. It is desirable in such wells to isolate each producing formation using a variety of flow control devices, such as packers and valves. It is also desirable to provide bi-directional isolation and interventionless actuation, such as interventionless opening, of one or more of the isolation devices. It is not unheard of, however, for the interventionless or mechanical actuation system to become fouled and unusable. In such circumstances, the isolation device, such as, for example, a ball valve, may need to be be drilled or milled out of the completion string. Such fouling and recovery efforts are obviously undesirable.

This application for patent discloses an improved isolation system and method of use comprising a first isolation device that is integral with the system, such as a pressure actuated valve or mechanically actuated valve, and a second isolation device, such as a plug, so that when both devices are closed, the formation is isolation and when the first device is open and the second device is closed, the formation is not isolated.

BRIEF SUMMARY OF THE INVENTION

One aspect of the invention comprises an isolation system for an oil or gas well having an isolation section and a first isolation device integral with the isolation section. A second isolation device comprising a plug may be sealingly coupled to the isolation section such that a hydrocarbon-bearing formation adjacent the isolation system is isolated from production when the first and second isolation devices are closed and such that the formation is not isolated from production when the first isolation device is opened and the second device remains closed.

Another aspect of the invention comprises a method of isolating a reservoir in a well by providing an isolation system comprising an integral first isolation device and a sealing portion for a second isolation device; inserting a plug as the second isolation device into the isolation system to isolate the formation; and removing the formation isolation by interventionlessly actuating the first isolation device while the second device remains closed.

Figure 1:
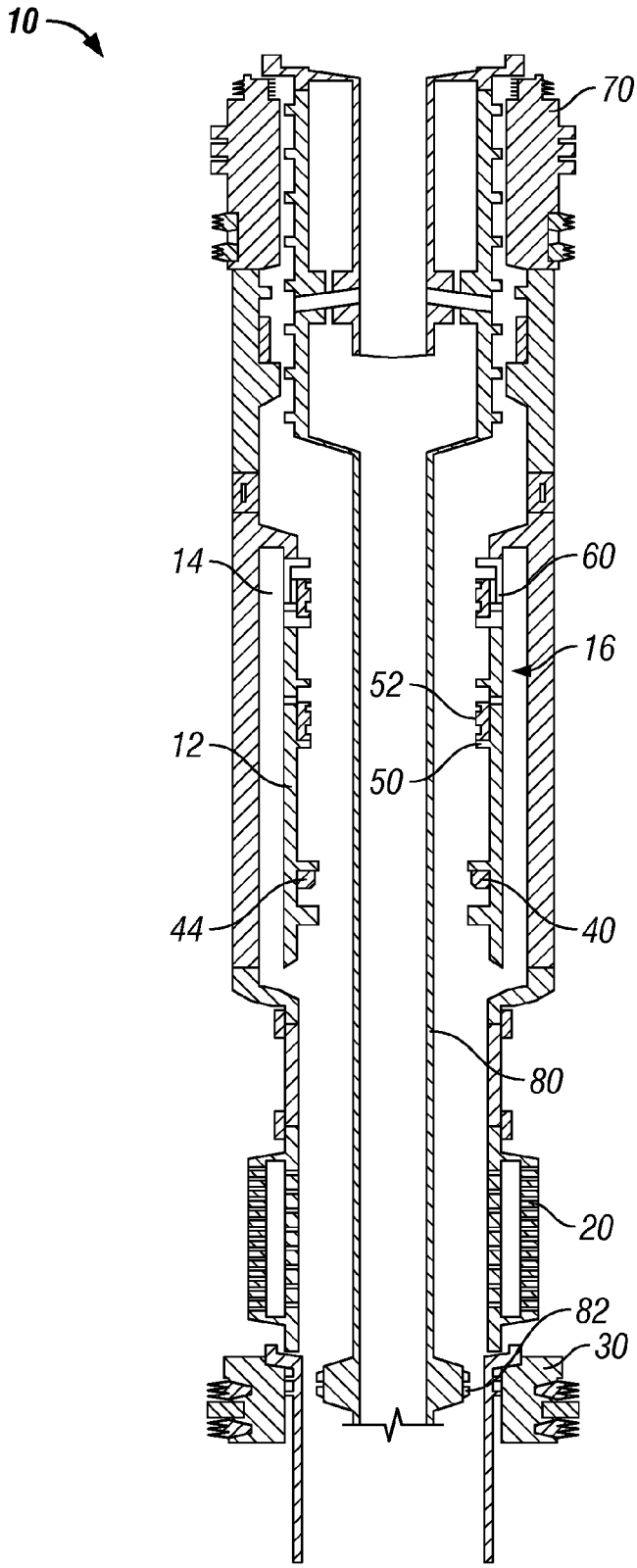
FIG. 1 illustrates an isolation system according to the present invention prior to completion.

While the inventions disclosed herein are susceptible to various modifications and alternative forms, only a few specific embodiments are shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art as required by 35 U.S.C. § 112.

DETAILED DESCRIPTION

One or more illustrative embodiments incorporating the invention disclosed herein are presented below. Not all features of an actual implementation are necessarily described or shown for the sake of clarity. For example, the various seals, vents and others design details common to oil well equipment are not specifically illustrated or described. It is understood that in the development of an actual embodiment incorporating the present invention, numerous implementation-specific decisions must be made to achieve the developer's goals, such as compliance with system-related, business-related and other constraints, which vary by implementation and from time to time. While a developer's efforts might be complex and time-consuming, such efforts would be, nevertheless, a routine undertaking for those of ordinary skill the art having benefit of this disclosure. Also, the use in this application of relative terms, such as, but not limited to, left, right, up, down, inside and outside, is not meant to preclude interchanging one for the other in other embodiments. Such relative terms are merely used for clarity of discussion of the particular embodiments disclosed herein.

In general terms, a formation isolation system has been created comprising a first isolation device integral with the isolation system in the well bore and a second isolation device that is not integral with the isolation system, which devices in combination isolate the formation of interest. The first isolation device may comprise a valve, such as a mechanical on/off valve, a variable choke valve, a shifting sleeve valve, a hydraulic or applied pressure actuated on/off or variable choke valve, or any combination thereof. The second isolation device may comprise a plug. Once the first and second isolation devices achieve zonal isolation, the first isolation device may be selectively opened, such as by pressure actuation or mechanical actuation, to permit productive flow from the previously isolated formation and thereafter closed to again isolate the particular formation. The second isolation device may be retrieved from the well or simply removed from its seat for post-completion services, as desired.

Turning now to FIG. 1 for a more detailed description of a presently preferred embodiment of the present invention, a completion system 10 is illustrated comprising a screen assembly 20 positioned adjacent a producing and usually unconsolidated formation (not shown). The screen assembly 20 is shown positioned up hole from a packer 30, which effectively seals the completion system 10 above and below the packer 30. The completion system 10 further comprises an isolation system 12, which in the embodiment illustrated in FIG. 1 comprises a first isolation device 16 comprising a mechanical valve 50 and a pressure actuated valve 60, and a second isolation device profile lock 40. Also shown in FIG. 1 is an upper packer 70 and service tool 80.

As illustrated in FIG. 1, the mechanical valve 50 of the first isolation device 16 is shown in the open condition, which permits fluid communication between the annular region 14 adjacent the isolation system 12 and the inside of the completion system 10. The pressure-actuated valve 60 of the first isolation device 16 is shown in the closed position. In this particular embodiment, the pressure-actuated valve 60 is biased to the closed position.

Figure 2:
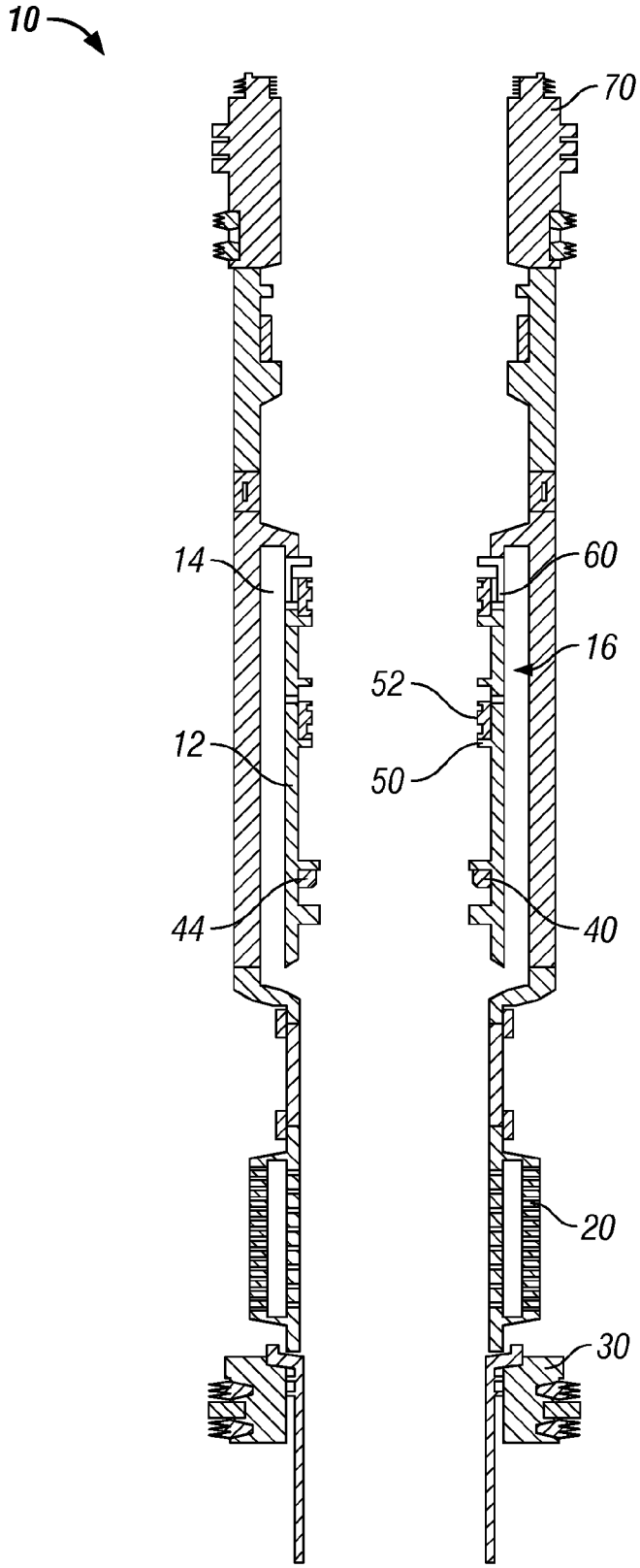
FIG. 2 illustrates an isolation system according to the present invention after a service tool has been run out of the well and prior to completion.

Prior to isolating the particular formation adjacent screen assembly 20, the service tool 80 may be withdrawn from the completion system 10. As the service tool is withdrawn, a shifting profile 82 may engage a corresponding profile 52 on the mechanical valve 50 to close the valve, thereby precluding fluid communication across the valve. FIG. 2 illustrates the completion system 10 with the first isolation device 16, i.e., the pressure actuated valve 60 and the mechanical valve 50, in the closed position.

Figure 3:
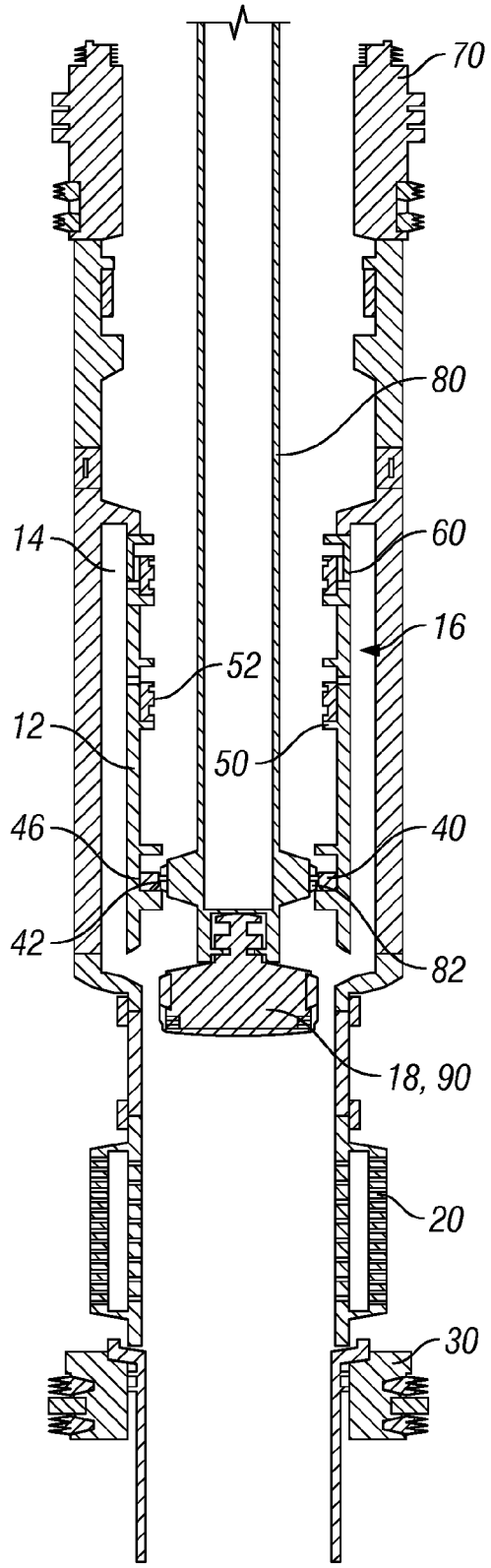
FIG. 3 illustrates the isolation system of FIG. 2 prior to setting the second isolation device.

FIG. 3 illustrates a second isolation device 18 in the form of a plug 90 being run into the well and the completion system 10 by service tool 80. In this sense, the second isolation device 18 is not integral to the isolation systems 12 as compared to first isolation device 16. The tool profile 82 engages the corresponding profile on mechanical valve 50 and opens the valve. The isolation plug 90 and locking profile 40 are constructed such that the plug 90 can pass through the profile 40 when a locking element 42 is in an initial position (position 44 shown in FIGS. 1 and 2). The service tool profile 82 engages the locking profile element 42 and causes the element 42 to move to a secondary position 46. Continued travel of the tool 80 releases the profile 82 from the element 42.

Figure 4:
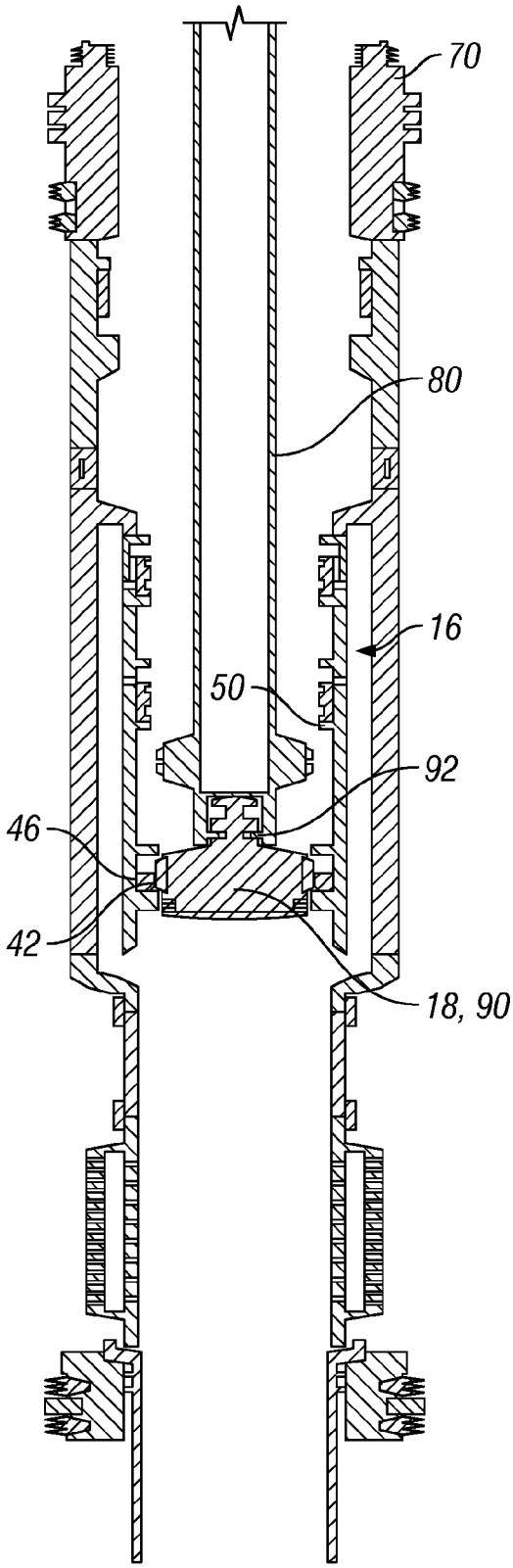
FIG. 4 illustrates the isolation system of FIG. 3 after the second isolation device has been locked in place.

As illustrated in FIG. 4, subsequent up hole travel of the tool 80 causes the isolation plug 90 to engage the locking element 42. Because the mechanical valve 50 is in the open state, the well pressure above and below the isolation plug 90 is substantially equal and fluid communication exists above and below the plug 90. When the plug 90 is locked into place with locking profile 40, the plug 90 and profile 40 create a fluid tight seal to well fluid pressures above and below the plug 90. The sealing system utilized by the second isolation device 18 may comprise elastomers, such as o-rings or other materials suitable for the intended environment.

Continued up hole travel of the service tool 80 causes the isolation plug 90 to release from the tool 80. In the presently described embodiment, the isolation plug 90 is releasably locked to the tool 80 by one or more shearable pins 92 having combined shear strength of between about 10,000 and 20,000 pounds of force. It will be appreciated that selection of the type of the releasable lock (such as shear pins, retractable dogs and other equivalent structures) and the loads or pressures at which the lock releases, are well within the design choice of those of ordinary skill in this art having benefit of this disclosure.

Figure 5:
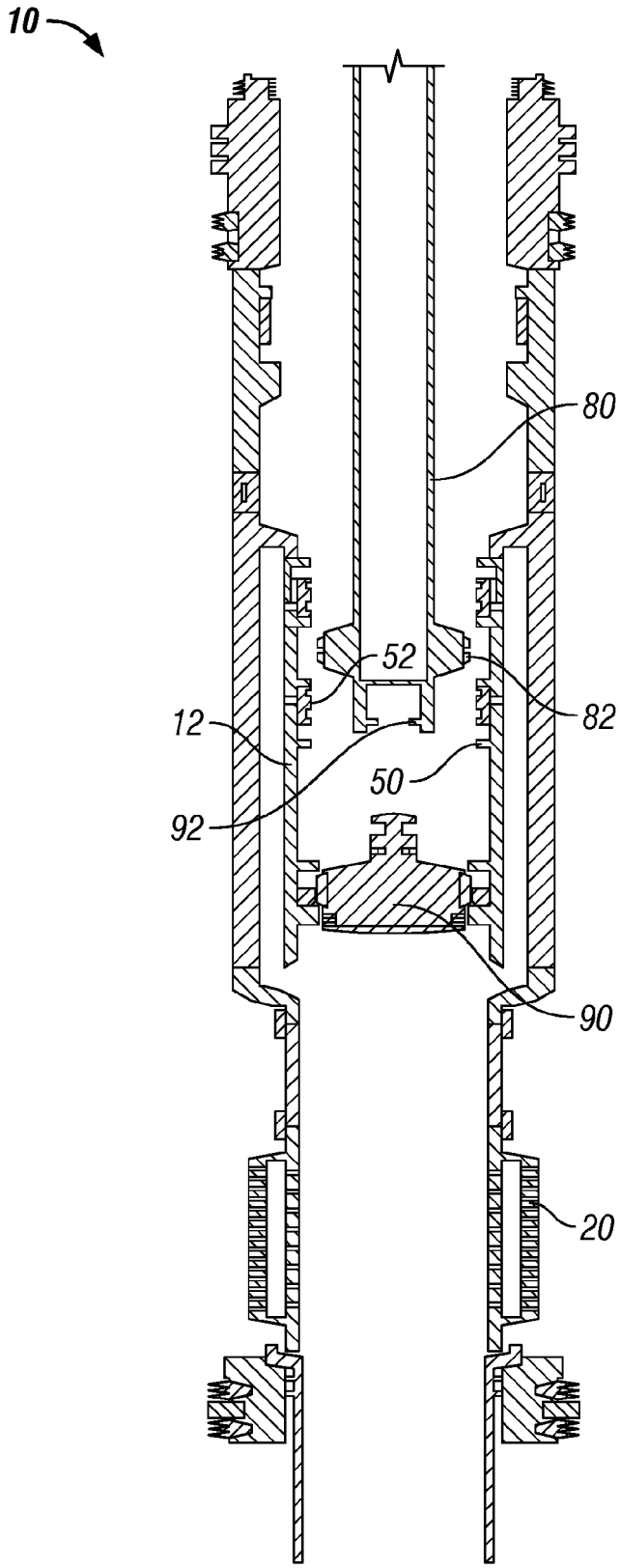
FIG. 5 illustrates the isolation system of FIG. 4 after the second isolation device has been released from a service tool.

FIG. 5 illustrates the isolation plug 90 locked into position in the isolation system 12 after the preferred shear pins 92 have been released. FIG. 5 also illustrates that the service tool profile 82 engages the mechanical valve profile 52 once again and closes the valve 50.

Figure 6:
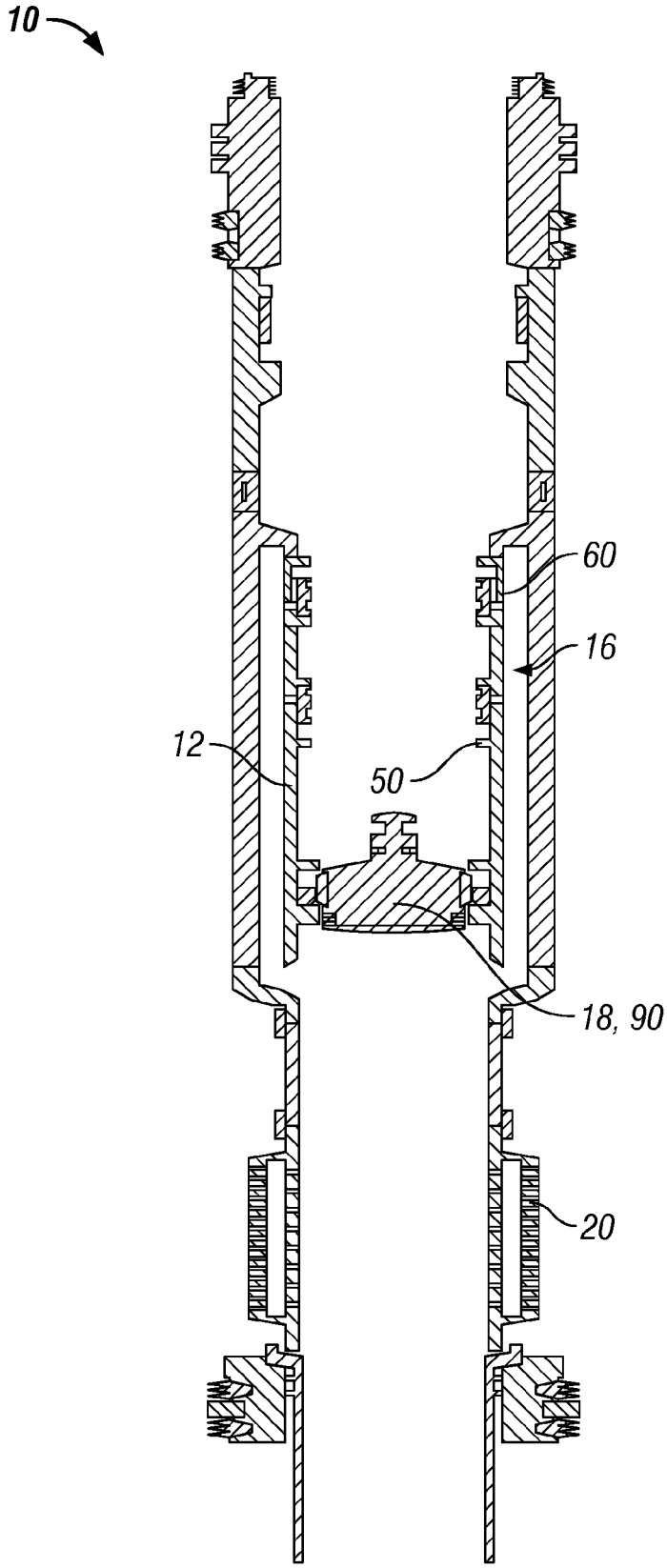
FIG. 6 illustrates the isolation system with the reservoir below the isolation system sealed off from production.

FIG. 6 illustrates the well, or at least the particular formation adjacent screen assembly 20, in a closed-in condition. This closed-in or isolated condition is formed by the closed mechanical valve 50 and the closed pressure actuated valve 60, which comprise the integral first isolation device 16, and the sealed plug 90, which comprises the second isolation device 18. In this condition, production fluids from the formation adjacent the screen assembly 20 may not enter the interior of the completion system 10 up hole of the isolation system 12.

When it is desired to produce fluids from the formation of interest, the presently described embodiment allows such production to begin without intervening into the well. For example, the pressure-actuated valve 60 of the first isolation device 16 may be any of a number of conventional pressure actuated valves, such as the Pressure Actuated Circulating Valve offered by BJ Services. As is typical for these types of valves, actuation is initiated by applying differential pressure from the valve ID to the OD. Initial actuation pressure unlocks the valve while maintaining pressure integrity. Reducing the actuation pressure to equal the annular pressure allows the valve to cycle to the full open position. Other types and designs of interventionless-open valves may be used as well.

Figure 7:
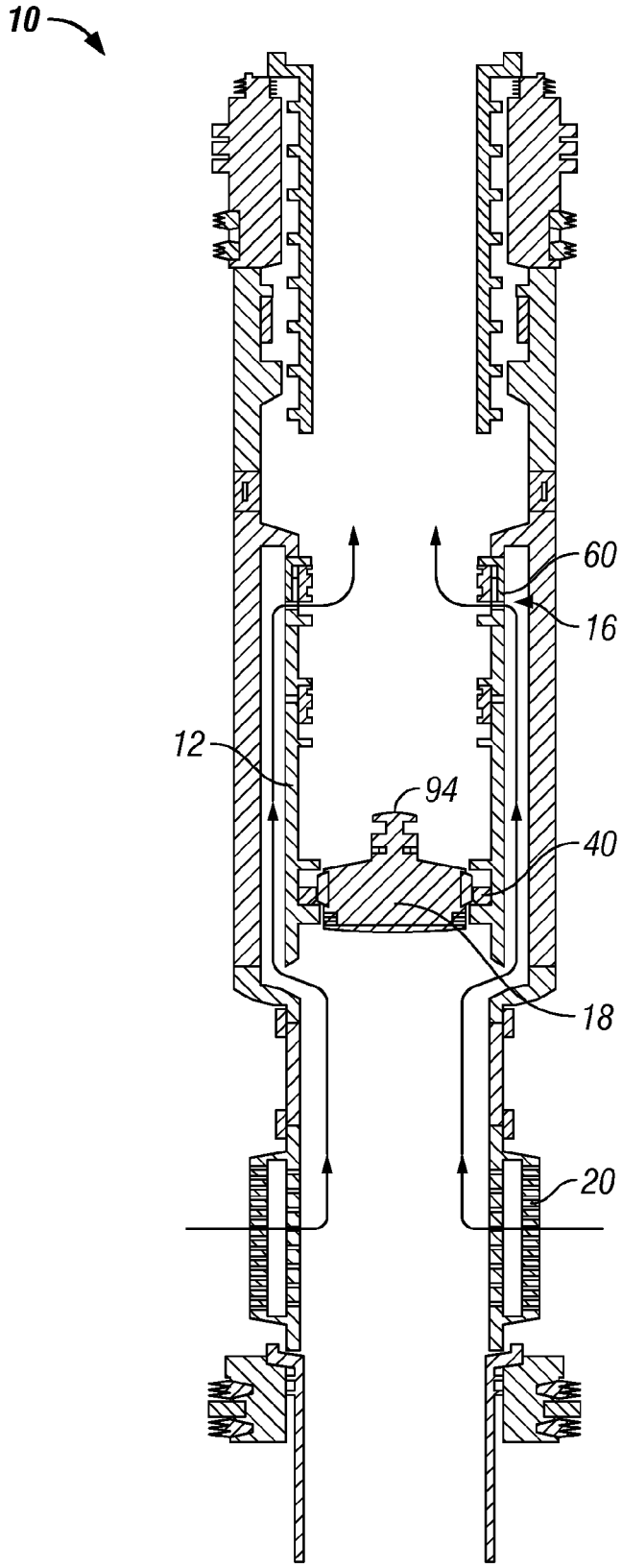
FIG. 7 illustrates the isolation system of FIG. 6 after the first isolation device has been opened to allow production from the reservoir.

Once opened, as illustrated in FIG. 7, well fluids may flow from the formation through the screen assembly 20 into the completion system 10 below the isolation system 12, in to the annular region 14, through the now-opened pressure actuated valve 60 and into the interior of the completion system 10 above the isolation system 12.

In the event that the pressure-actuated valve 60 fails to open, the valve 60 may be fitted with a mechanical opening and or closing system. For example, the BJ Services Pressure Actuated Circulating Valve includes a backup mechanical shifting profile that allows the valve to be opened and closed with a service tool 80 such as BJ Services Multi-Action Shifting Tool. It will be appreciated that the mechanical valve 50 described above may also be opened with a similar service tool.

The flow areas in the presently preferred embodiment are designed to be substantially similar so that no one component acts as a substantial flow restrictor. For example, an embodiment incorporating the present invention may be constructed such that the primary flow path through the first isolation device 16, e.g., pressure actuated valve 60, has a inside diameter (ID) of about 4.5 inches, yielding an ID flow area of about 15.9 square inches. The valved flow area through valve 60 may be about 17.0 square inches comprising 8 flow slots 3.0 inches long by 0.75 inch wide. The flow area through the annular region 14 may be about 16.8 square inches and the flow are through the screen assembly may be about 17.9 square inches. Thus, in the presently preferred embodiment, the relevant flow areas are substantially the same. This type of design can limit additional pressure drop across the isolation system 12 during production to about 1 psi at 10,000 barrels of oil per day; about 2.3 psi at 20,000 BOPD and about 5.3 psi at 30,000 BOPD. For injection services, the additional pressure drop may be limited to about 1 psi at 30,000, 40,000 and 50,000 BOPD.

The second isolation device 18, which in this presently preferred and described embodiment is isolation plug 90, may be retrieved by conventional means, such as a service tool 80, or it may be knocked loose from its sealed position to allow post-completion servicing of the well. For example, isolation plug 90 may be constructed with a release system 94 that permits a service tool to both engage the plug for retrieval and release it from its locked and sealed position. Alternately, the release 94 may be actuated with out engaging the plug 90, thereby allowing the plug to fall or float, as the case may be. If the plug 90 becomes stuck in the locking profile 40 and cannot be retrieved or knocked loose, the plug can be milled or drilled out of the isolation system 12. For embodiments that use a plug as the second isolation device 18, the plug may be of conventional construction, including, but not limited to, alloy steel, aluminum or composite materials. It will often times be desirable to construct the plug or other second isolation device 18 to be more easily drilled or milled than a conventional alloy steel ball valve isolation device.

The embodiment described above is only one of many different embodiments that may be constructed to capitalize on the present invention. For example, although the first isolation device 16 of the preferred embodiment comprises a mechanical valve 50, such as the Multi-Service Valve offered by BJ Services, and a pressure actuated valve 60, such as the Pressure Actuated Circulating Valve offered by BJ Services, embodiments of the present invention may be constructed in which the first isolation device comprises a mechanical valve only or a pressure actuated valve only or any combination of other valves. Further, the second isolation device 18 may be constructed with a built-in fluid bypass to equalize well fluid pressure above and below the device while it is being locked in position. In the embodiments illustrated above, for example FIG. 5, removing the service tool 80 from the second isolation device 18 may cause the fluid bypass to close.

It will be appreciated by those of ordinary skill in this art having the benefit of this disclosure that features illustrated with respect to the embodiments described herein may have application or utility with another embodiment described herein or with another embodiment of the invention inspired by this disclosure. For example, the embodiments illustrated herein have been described in terms axially acting sleeve valves. It is well within the scope of the invention to utilize other types of mechanically and pressure actuated valves. The invention has been described in the context of preferred and other embodiments and not every possible embodiment of the invention has been described. Obvious modifications and alterations to the described embodiments are available to those of ordinary skill in the art. The disclosed and undisclosed embodiments are not intended to limit or restrict the scope or applicability of the invention, but rather, in conformity with the patent laws, this patent is intended to protect all such modifications and improvements to the full extent that such falls within the scope or range of equivalent of the following claims.

What is claimed is:

1. An isolation system for an oil or gas well, comprising:
an isolation section;
a first isolation device integral with the isolation section;
a second isolation device comprising a plug sealingly coupled to the isolation section; and
wherein a formation adjacent the isolation system is isolated from production when the first and second isolation devices are closed and wherein the formation is not isolated from production when the first isolation device is opened and the second device remains closed.

2. The system of claim 1, wherein the first isolation device comprises a pressure actuated valve.

3. The system of claim 2, wherein the first isolation device also comprises a mechanical valve.

4. The system of claim 1, wherein the plug is more easily drilled or milled than an alloy steel ball valve.

5. The system of claim 1, wherein the plug may be retrieved from the system or removed from the system.

6. The system of claim 3, wherein the mechanical valve is opened while the plug is being set to equalize the pressure there across.

7. A method of isolating a formation in a well, comprising:
providing an isolation system comprising an integral first isolation device and a sealing portion for a second isolation device;
inserting a plug as the second isolation device into the isolation system to isolate the formation;
removing the formation isolation by interventionlessly actuating the first isolation device while the second device remains closed.

8. The method of claim 7, wherein the first isolation device comprises a pressure actuated valve.

9. The method of claim 8, wherein the first isolation device further comprises a mechanical valve.

10. The method of claim 9, further comprising opening the mechanical valve prior to or during installation of the plug.

11. The method of claim 9, further comprising running the plug into the isolation system on a service tool; opening the mechanical valve with service tool; and releasing the plug from the service tool once the plug is sealingly in place.

12. The method of claim 7, further comprising retrieving the plug from the isolation system for post-completion well service.

* * * * *